US006318854B1

(12) United States Patent
Rasmussen et al.

(10) Patent No.: US 6,318,854 B1
(45) Date of Patent: Nov. 20, 2001

(54) INKJET PRINTING MEDIA HANDLING SYSTEM WITH ADVANCING GUIDE SHIM

(75) Inventors: Steve O Rasmussen, Vancouver, WA (US); Steven B Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/163,275

(22) Filed: Sep. 29, 1998

(51) Int. Cl.[7] ..... B41J 29/42
(52) U.S. Cl. ..... 347/104; 400/624
(58) Field of Search ..... 347/104, 105, 347/218, 219, 101; 400/624, 636, 642, 635, 645, 645.3

(56) References Cited

U.S. PATENT DOCUMENTS

| | | | | |
|---|---|---|---|---|
| 4,207,579 | | 6/1980 | Gamblin et al. . | |
| 4,447,817 | | 5/1984 | Naramore . | |
| 4,660,752 | | 4/1987 | Rikard et al. . | |
| 4,682,904 | | 7/1987 | Yoshimura et al. . | |
| 4,821,049 | | 4/1989 | Eckl . | |
| 4,843,338 | | 6/1989 | Rasmussen et al. . | |
| 5,019,839 | * | 5/1991 | Watanabe et al. | 346/134 |
| 5,276,970 | | 1/1994 | Wilcox et al. . | |
| 5,342,133 | | 8/1994 | Canfield . | |
| 5,345,863 | | 9/1994 | Kurata et al. . | |
| 5,393,151 | | 2/1995 | Martin et al. . | |
| 5,419,644 | | 5/1995 | Martin et al. . | |
| 5,456,544 | * | 10/1995 | Aoki et al. | 400/642 |
| 5,593,240 | | 1/1997 | Broder et al. . | |
| 5,730,537 | * | 3/1998 | Kelly et al. | 400/625 |
| 5,800,076 | * | 9/1998 | Umeda | 400/645.3 |
| 5,943,081 | * | 8/1999 | Uchida et al. | 347/104 |
| 6,106,115 | * | 8/2000 | Mueller et al. | 347/104 |

FOREIGN PATENT DOCUMENTS

| | | |
|---|---|---|
| 5112001 | 5/1993 | (EP) . |
| 0640479 | 3/1995 | (EP) . |
| 7304167 | 11/1995 | (EP) . |
| 6048385 | 3/1985 | (JP) . |

* cited by examiner

*Primary Examiner*—John S. Hilten
*Assistant Examiner*—Darius N. Cone

(57) ABSTRACT

Accurate advance of a media sheet is achieved by carrying the media sheet on a belt loop. An upstream pinch roller holds the media sheet to the belt upstream of the print zone. A downstream pinch roller holds the media sheet to the belt downstream of the print zone. A guide shim extends along the media path from a position upstream of the upstream pinch roller, passed the upstream pinch roller toward the print zone. The guide shim advances with the bottom edge of the media sheet into the print zone to stabilize the trailing edge so as to allow for a smaller minimum bottom margin.

3 Claims, 3 Drawing Sheets

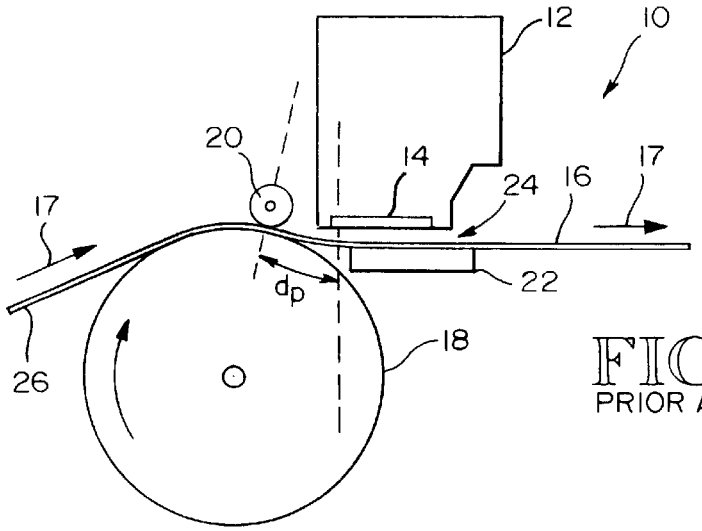
FIG. 1
PRIOR ART
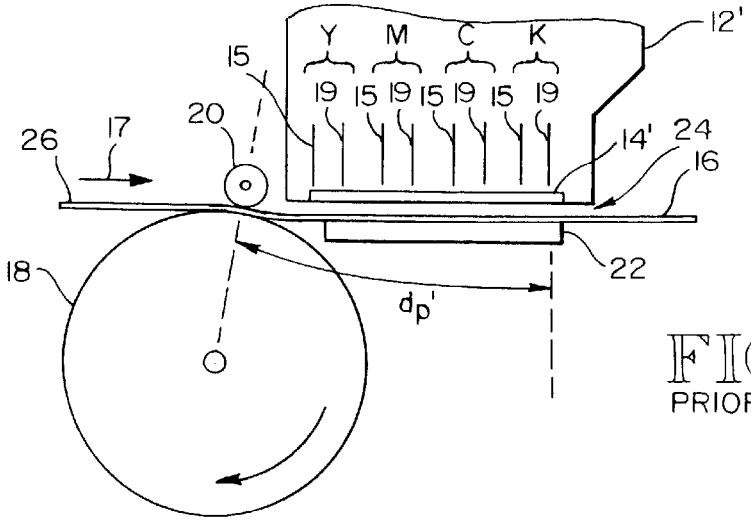
FIG. 2
PRIOR ART
FIG. 6
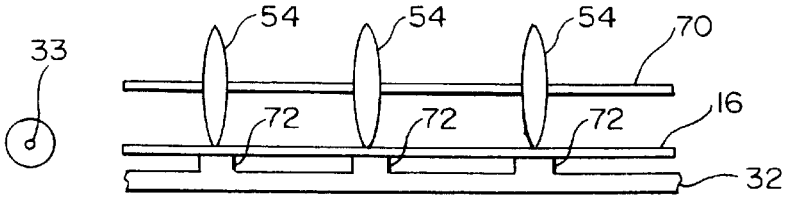

FIG. 3
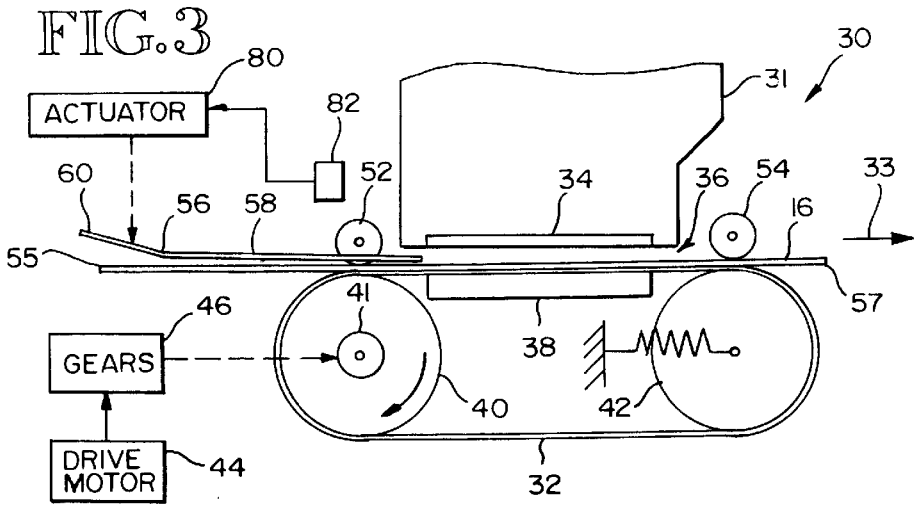
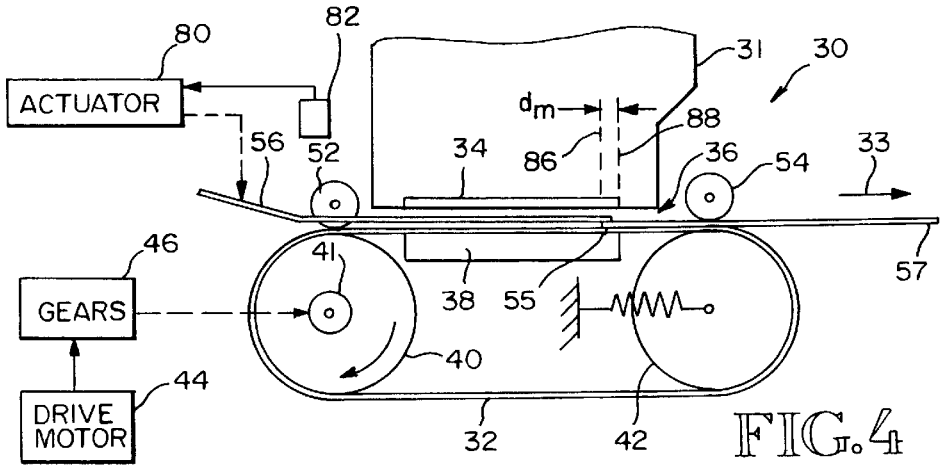
FIG. 4
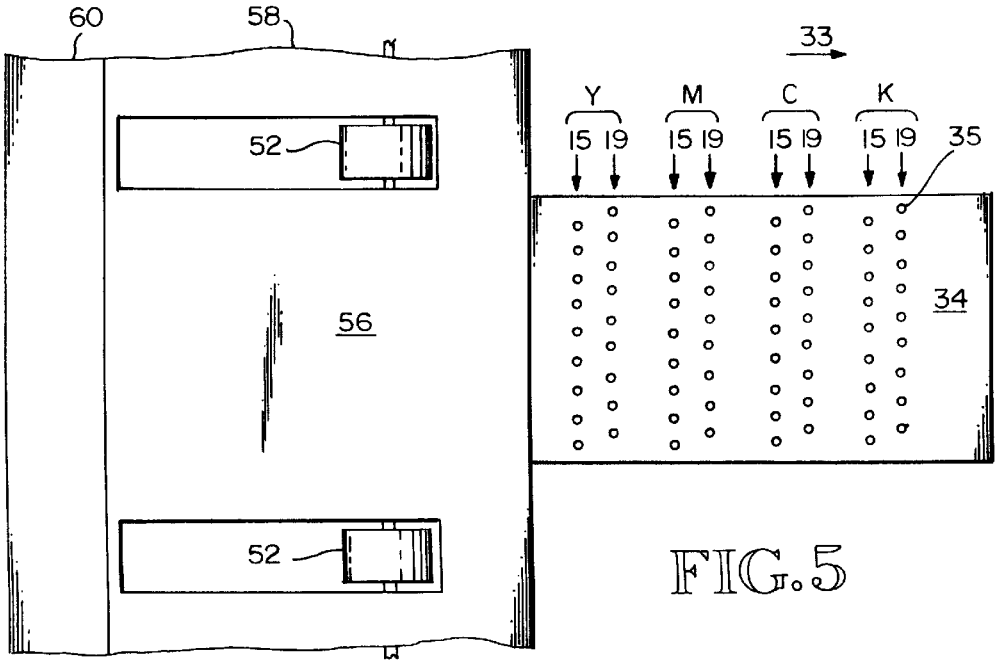
FIG. 5

FIG. 7
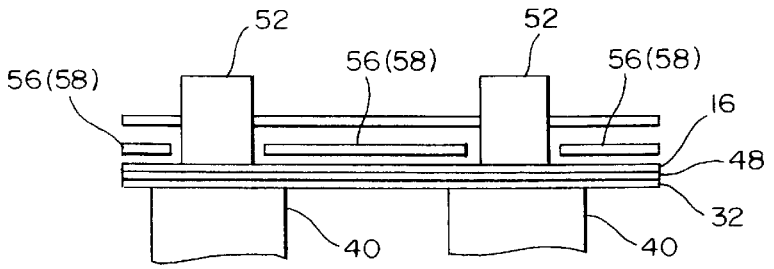
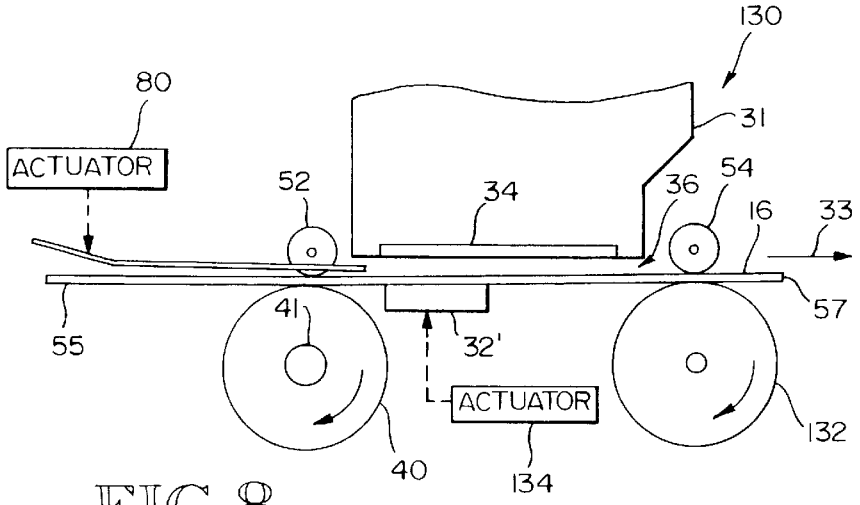
FIG. 8
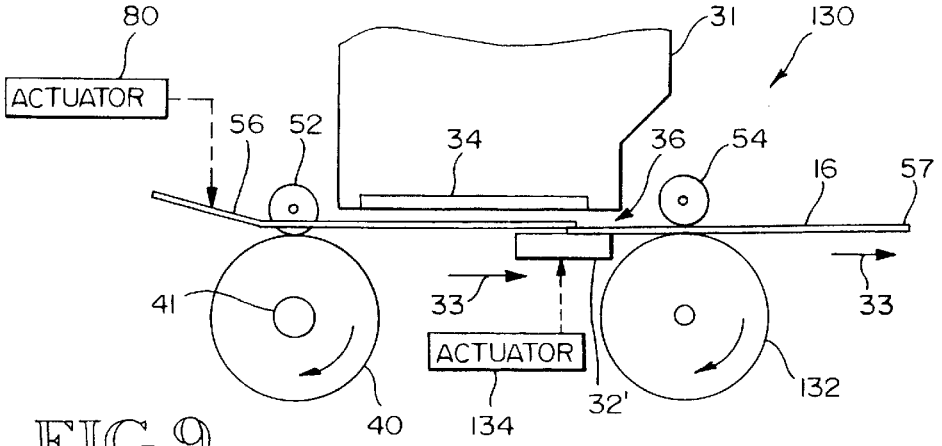
FIG. 9

INKJET PRINTING MEDIA HANDLING SYSTEM WITH ADVANCING GUIDE SHIM

BACKGROUND OF THE INVENTION

This invention relates generally to media handling systems for inkjet printing devices, and more particularly to a media handling system which is capable of achieving small bottom margins.

Known inkjet printing devices which use single sheet or cut sheet media have a limited bottom margin capability. One of the smallest bottom margins achievable is approximately 11.7 mm by the Hewlett Packard 800 series DeskJet™ printers. Many applications could take advantage of a smaller bottom margin, if available on single sheet and cut sheet inkjet printers. Continuous form inkjet products are able to achieve smaller bottom margins because a current page is attached to a subsequent page during printing. The pages are detached after printing.

Other inkjet printing concerns which impact the bottom margin limitation are the need for accurate dot placement and the need to account for the effects of wet ink printing. Both of these concerns impact a larger portion of the media sheet than simply the immediate area being printed at any given time. Media handling is one function controlled to achieve accurate printing and wet ink control. In the series 800 DeskJet™ printers, for example, pinch rollers keep the media sheet in contact with a drive roller as the media sheet is fed through a print zone adjacent to a printhead. The pinch rollers prevent media slippage and allow for accurate dot placement. Cockle control devices such as ribbed devices place a known bend pattern in the paper downstream from the print zone which limits cockle growth in the print zone. The pinch rollers isolate the cockled area from a flat media sheet area in the print zone.

FIG. 1 shows a conventional inkjet printing apparatus 10 including an inkjet pen 12 having a printhead 14. The printhead 14 includes a plurality of inkjet nozzles which eject ink onto a media sheet 16 during printing. The media sheet is moved along a media path in a direction 17 by one or more rollers, including a drive roller 18. A pinch roller 20 presses the media sheet to the drive roller 18. A platen 22 supports the media sheet as the media sheet 16 is moved through a print zone 24. Typically, the print zone is located close to the pinch roller's line of contact with the media sheet, but further along the media sheet path than the pinch roller's line of contact. More specifically, the print zone 24 is located adjacent to the printhead nozzles between the printhead 14 and the platen 22. The relative location of the pinch rollers relative to the print zone determines how small the bottom margin can be. Once a trailing edge 26 of the media sheet 16 passes beyond the pinch roller 20, there is nothing securing the media sheet as the trailing edge 26 advances through the print zone 24. Accordingly, printing on the media sheet after contact is lost with the pinch roller 20 is subject to inaccuracies. The manufacturer avoids these inaccuracies by making the minimum bottom margin large enough that the media sheet is still in contact with the pinch roller at the bottom margin. Typically the distance from the nearest edge of the print zone to the pinch roller line of contact equals the minimum bottom page margin achievable for an inkjet print apparatus. Referring to FIG. 1, the minimum bottom page margin for the media sheet 16 is limited by the distance $d_p$ from the pinch roller 20 line of contact to the nozzle area of the printhead 14.

In a page wide array inkjet printhead the nozzle rows are oriented 90 degrees about the typical scanning printhead nozzle row orientation. In the FIG. 1 scanning inkjet pen 12 the nozzle rows are oriented in a direction across the drawing sheet from left to right in the areas marked for the printhead 14. FIG. 2 shows a page wide array configuration. Inkjet pen 12' includes a pagewide array printhead 14' having a pair of rows 15, 17 for each color (e.g., YMCK—yellow, magenta, cyan and black). The rows 15, 17 are oriented to extend into the page of the drawing sheet.

Referring to FIG. 2, the media sheet 16 is moved along a media path in the direction 17 by one or more rollers, including a drive roller 18. A pinch roller 20 presses the media sheet to the drive roller 18. A platen 22 supports the media sheet as the media sheet 16 is moved through a print zone 24. Once a trailing edge 26 of the media sheet 16 passes beyond the pinch roller 20, there is nothing securing the media sheet as the trailing edge 26 advances through the print zone 24. Accordingly, the minimum bottom margin is made large enough that the media sheet is still in contact with the pinch roller. With the nozzles oriented in the direction parallel to the length of the pinch rollers and drive rollers, the minimum bottom margin is limited by the first row of nozzles located farthest from the pinch roller 20 (row 17 of color K in FIG. 2). Referring to FIG. 2, the minimum bottom page margin for the media sheet 16 is limited by the distance $d_{p'}$ from the pinch roller 20 line of contact to the nozzle area of the printhead 14'. For a YMCK printhead, the minimum bottom margin would be greater than 1 inch.

One way of reducing the minimum bottom margin is to place the pinch roller 20 closer to the print zone 24. There is a limit, however, to how close the pinch roller line of media sheet contact can be to the print zone. Another scheme is to make the pinch roller diameter smaller, so that the distance between the print zone and pinch roller can be shorter. However, media advance accuracy suffers as the pinch roller becomes too small.

The pinch roller also serves to provide a reverse bowing which reduces cockle growth from the wet ink printing. Cockle growth refers to the buckling or ridges in a media sheet due to the presence of wet ink soaking into the media sheet. As the pinch roller becomes too small the reverse bow desired for limiting cockle growth becomes difficult to maintain. Accordingly, there is a need for a method and apparatus for allows for smaller bottom margins than the distance between pinch roller and print zone.

SUMMARY OF THE INVENTION

According to the invention, a media handling system provides accurate positioning of a media sheet through a print zone to allow for smaller bottom margins than known minimum bottom margins for single sheet or cut sheet inkjet printing devices. Minimum bottom margins less than 5 mm, and as low as 1 mm or 2 mm are achieved. This is a substantial improvement over the 11.7 mm minimum bottom margin achieved by current inkjet printing devices.

According to one aspect of the invention the media sheet is positioned on a support while traveling through the print zone. In addition to a pinch roller located along the media path prior to the print zone (i.e., an upstream pinch roller), there may be an another optional pinch roller located after the print zone (i.e., a downstream pinch roller). The support and pinch rollers stabilize the media sheet while the media sheet moves through the print zone. The downstream pinch roller may be of a star wheel configuration to minimize contact with the media sheet and avoid smudging the wet ink on the media sheet. A function of the downstream pinch roller is to hold the media sheet down and away from the inkjet printhead. Another function is to assist in advancing the media, especially once the media sheet trailing edge has passed beyond the upstream pinch roller.

According to another aspect of the invention, a guide shim is operatively positioned with the upstream pinch roller. The guide shim extends along the media path beyond the upstream pinch roller toward the print zone. The guide shim abuts or comes close to the print zone. The location of a lead edge of the guide shim relative to the print zone determines the minimum bottom margin for the inkjet printing device. One function of the guide shim is to provide media advance accuracy as the media sheet trailing edge departs contact with the upstream pinch roller and continues on to the print zone. Another function is to maintain the media flatness as the media sheet continues to the print zone. The guide shim serves to keep the media sheet under the inkjet printhead as the media sheet moves under the printhead. Cockle growth is limited by maintaining such flatness.

According to another aspect of this invention, the guide shim advances with the bottom edge of the media sheet into the print zone. As the guide shim is advanced, it keeps the media sheet in contact with the support, providing advance accuracy and minimal paper to pen spacing. The movement of the shim into the print zone also allows the minimum bottom margin to decrease. The minimum bottom margin is the distance from a prescribed location on the printhead to a portion under the distal edge of the advanced guide shim. For nozzle rows oriented perpendicular to the media path, the prescribed location on the printhead is the location of the nozzle row furthest from the guide shim. For nozzle rows oriented parallel to the media path, the prescribed location on the printhead is the location of the nozzles which are closest to the guide shim.

According to another aspect of the invention, the support is an endless belt loop driven by drive rollers. Preferably the belt has a ribbing or a grit coating. The media sheet rests on the belt and is stationary relative to the belt while moving through the print zone. The belt provides a continuous surface moving uniformly from the upstream pinch roller to the downstream pinch roller. The ribbing serves to reduce cockle growth due to the wet ink received on the media sheet. A grit coating, however, maintains more accurate referencing between the media sheet and the belt.

According to an alternative aspect of this invention, the support is a stationary platen which extends at least the length of the print zone. The media sheet is fed from the upstream pinch roller onto the platen, through the print zone and to the downstream pinch roller. The upstream pinch roller in combination with a drive roller and the downstream pinch roller in combination with another drive roller advance the media sheet.

According to an alternative aspect of this invention, the support is a moving platen which travels a path between the upstream pinch roller and downstream pinch roller through the print zone. The media sheet is fed from the upstream pinch roller onto the platen, through the print zone and to the downstream pinch roller. The upstream pinch roller in combination with a drive roller and the downstream pinch roller in combination with another drive roller advance the media sheet. The platen travels through the print zone with the trailing edge of the media sheet.

One advantage of the support, pinch roller, guide shim configuration is that media advance accuracy is maintained, and cockle growth is controlled, even while the media sheet trail edge leaves contact with the upstream pinch roller. A beneficial effect is that the minimum bottom margin is reduced. An advantage of the shim is that media advance accuracy is maintained even for pinch rollers which do not spin at identical speeds (e.g., due to manufacturing tolerances). These and other aspects and advantages of the invention will be better understood by reference to the following detailed description taken in conjunction with the accompanying drawings.

BRIEF DESCRIPTION OF THE DRAWINGS

FIG. 1 is a diagram of a portion of a conventional media handling system for illustrating minimum bottom margin;

FIG. 2 is a diagram of a portion of another conventional media handling system for illustrating minimum bottom margin;

FIG. 3 is a diagram of a portion of an inkjet printing apparatus according to an embodiment of this invention;

FIG. 4 is a diagram of the inkjet printing apparatus of FIG. 3 showing the guide shim in an advanced position;

FIG. 5 is a diagram of the inkjet printhead and guide shim of FIG. 3;

FIG. 6 is a cross sectional view of a portion of the belt and downstream star wheel pinch rollers of FIG. 3 according to one embodiment of this invention;

FIG. 7 is a cross sectional view of a portion of the belt, guide shim and upstream pinch rollers of FIG. 3 according to one embodiment of this invention;

FIG. 8 is a diagram of a portion of an inkjet printing apparatus according to another embodiment of this invention; and FIG. 9 is a diagram of the inkjet printing apparatus of FIG. 8 showing the guide shim in an advanced position.

DESCRIPTION OF SPECIFIC EMBODIMENTS

FIGS. 3 and 4 show an inkjet printing apparatus 30 which allows for a smaller bottom margin than the distance between the pinch roller and inkjet nozzles. The inkjet printing apparatus 30 includes an inkjet pen 31 having a printhead 34. In various embodiments the inkjet pen 31 is a scanning type pen which moves orthogonal to the direction of motion of a media sheet 16 along its media path, or a page wide array pen which is stationery relative to the media handling components. The inkjet printhead 34 includes a plurality of inkjet nozzles 35 (see FIG. 5) which eject ink onto a media sheet 16 during printing. The nozzles are arranged in a plurality of rows. In one embodiment the nozzle rows extend along the direction of the media path direction 33. In another embodiment (as illustrated) the nozzle rows extend along a direction orthogonal to the media path direction 33. Although a typical scanning type printhead has nozzle rows extending parallel to the media path, an orientation in which the rows extend orthogonal to the media path, or extend a diagonal, or otherwise non-orthogonal, to the media path may be used. The nozzle rows may extend in any of such directions for the scanning type printhead or the page wide array printhead. Referring to FIG. 5 a printhead embodiment is shown having a pair of nozzle rows corresponding to each one of multiple colors of ink extending perpendicular to the media path direction 33. For a page wide array embodiment the rows 15, 17 of nozzles 35 extend at least a page width.

The media sheet 16 is moved along a media path in a direction 33 by one or more rollers. Over a portion of the media path, the media sheet 16 is carried by a support 32. In a preferred embodiment the support is an endless belt loop. A print zone 36 occurs between the printhead 34 and the belt 32 in a region adjacent to the nozzles 35. The print zone 36 is the area where ink is ejected onto the media sheet 16. Within the print zone 36, a platen 38 maintains the belt 32 in a fixed orientation. As a result, the media sheet 16 is positioned at a known flat orientation within the print zone and ink is accurately applied to the media sheet 16.

The belt 32 runs along a drive roller 40 and an idler roller 42. One or more drive rollers 40 are mounted to a drive shaft 41. The drive shaft 41 is rotated by a drive motor 44 through a gear train 46 causing the belt 32 to move along the rollers 40, 42. The idler roller 42 preferably is spring-loaded to maintain the belt at a desired tension. Preferably, the belt 32 is stiff enough to prevent stretching over time. The belt 32 is reinforced with Kevlar in some embodiments to resist stretching. The spring-loading of idler roller 42 serves to maintain a desired belt tension even in the presence of some belt stretching. In one embodiment the belt is ribbed (see FIG. 6). The ribbing adds a measure of stability to the media sheet which helps reduce cockling of the media sheet 16. In another embodiment the belt has a grit coating 48, rather than ribs (see FIG. 7). For the belt embodiment having a grit coating, particles are dispersed within or on top of a coating. In an exemplary embodiment, an ultrahigh molecular weight polyethylene coating is used with a grit of aluminum oxide particles having an average particle size of 0.0005 inches to 0.005 inches. One of ordinary skill in the art will appreciate that other coating and particle sizes also may be used. The inventive concepts also apply for a smooth belt.

The printing apparatus 30 also includes an upstream pinch roller 52, a downstream pinch roller 54, and a guide shim 56. The upstream pinch roller 52 presses the media sheet 16 to an outer surface of the belt 32 in an area between the upstream pinch roller 52 and the drive roller 40 (see FIGS. 3 and 7). The downstream pinch roller 54 presses the media sheet 16 to an outer surface of the belt 32 in an area between the downstream pinch roller 54 and the idler roller 42. Preferably the downstream pinch roller 54 has a star wheel configuration which minimizes contact between the pinch roller 54 and the media sheet 16. This is desirable to avoid smudging the ink recently applied to the media sheet 16. The star wheel rollers 54 may be idle with individual mountings, or may be driven and have a common axle 70 (see FIG. 6). For the ribbed belt, the ribbing extending along the direction of motion 33. The media sheet 16 moves under the star wheel rollers 54 along the ribs 72 of belt 32, as shown in FIG. 6.

The guide shim 56 includes a first portion 58 which is oriented generally parallel to the media path and a second portion 60 which is angled relative to the media path. The guide shim 56 second portion 60 is located upstream from the upstream pinch roller 52. The guide shim first portion 58 extends past the upstream pinch roller 52 toward the print zone 36. The guide shim second portion 60 is angled to direct an oncoming media sheet between the upstream pinch roller 52 and the drive roller 40 and onto the belt 32. The guide shim 56 serves to keep the media sheet 16 under the inkjet printhead 34 as the media sheet moves under the printhead 34. This is desirable to prevent buckling of the media sheet, in which the media sheet 16 bends upward into contact with the inkjet nozzles 35. Such contact can clog the inkjet nozzles 35 and cause inaccurate dot placement.

The guide shim portion 58 has a flat orientation relative to the media path through the print zone 36 as shown in FIGS. 3 and 4. For a belt having a grit coating 48, the upstream pinch roller 52 presses the media sheet into the grit coating, which in effect adds a degree of friction and stability to the position of the media sheet 16 relative to the belt 32. Such stability continues while the media sheet's trailing edge 55 passes beyond the pinch roller 52 toward the print zone 36.

In a preferred embodiment the printing apparatus 30 also includes an actuator 80 which advances the guide shim 56 along the direction 33 of the media path. In one embodiment the actuator includes a roller which is in frictional contact with a surface of the guide shim 56. The roller is driven by a motor under the control of a controller. The controller receives information on the paper position from a media edge sensor 82. Once the trailing edge 55 of the media reaches a prescribed position, the actuator controller causes the actuator motor to advance the guide shim through, for example, a rack and pinion drive system. The prescribed position is where a prescribed portion of the media sheet trailing edge (e.g., 1 mm) is all that remains under the guide shim 56.

In operation the drive roller 40 is rotated causing the belt 32 to rotate. A lead edge 57 of the media sheet 16 is guided by the shim 56, the upstream pinch roller 52 and drive roller 40 onto the belt 32. The belt 32 carries the media sheet 16 as the drive roller 40 moves the belt 32 and the upstream pinch roller 52 presses a passing portion of the media sheet toward the drive roller 40. The belt 32 passes along the platen 38 carrying a portion of the media sheet 16 into the print zone 36. The printhead nozzles 35 eject ink onto the portion of the media sheet 16 within the print zone 36. The printed portion of the media sheet 16 is carried onward from the print zone 36 along belt 32 to the downstream pinch roller 54. The downstream pinch roller 54 presses the media sheet toward the idler roller 42. Preferably the downstream pinch roller 54 has a star wheel configuration which minimizes contact between the pinch roller 54 and the media sheet 16. This is desirable to avoid smudging the ink recently applied to the media sheet 16.

Once the trailing edge 55 of the media reaches a prescribed position along the media path, the actuator advances the guide shim 56 along the media path in the direction 33. During such advancement the trailing edge 55 of the media sheet 16 is between the support 32 and the guide shim 56. The prescribed position is where a prescribed portion of the media sheet trailing edge (e.g., 1 mm) is all that remains under the guide shim 56. The guide shim 56 advances with the media sheet along the media path until the trailing portion 55 of the media sheet 16 advances to the end of the print zone 36 (e.g., until the minimum bottom margin is reached). Note that the guide shim 56 advances into the print zone 36 trailing the end portion of the media sheet (including the trailing edge 55) and shielding or pushing the most distal trailing edge 55 of the media sheet 16.

Typically, a media sheet 16 is longer than the distance from the upstream pinch roller 52 to the downstream pinch roller 54 along the media path. As a result, at least one of the upstream pinch roller 52 and downstream pinch roller 54 is in contact with the media sheet 16 while ink is being ejected onto any portion of the media sheet 16. The pinch rollers 52, 54 introduce a measure of stability to the media sheet during printing. In one embodiment the belt 32 is ribbed. The ribbing adds another measure of stability to the media sheet which helps reduce cockling of the media sheet 16. In addition the guide shim 56 holds a portion of the media sheet flat. The guide shim also serves to keep the media sheet under the inkjet printhead as the printhead 14 moves over the media sheet 16. This is desirable to reduce cockling of the media sheet where the media sheet bends upward into contact with the inkjet nozzles. Such contact can clog the inkjet nozzles 35 and cause inaccurate dot placement.

Thus, the guide shim 56 also aids in media advance accuracy as the media sheet trailing edge 55 departs contact with the upstream pinch roller 52 and continues on to the print zone 36. Specifically portion 58 of the guide shim 56 extends past the upstream pinch roller 52 toward and into the print zone 36. The shim 56 together with the star wheel contact of the downstream pinch roller 54 stabilizes the media sheet 16 as the trailing edge 55 moves toward and through the print zone 36.

An advantage of the stabilizing action of the shim 56 and downstream pinch roller 54 is that the minimum bottom margin is not limited to the distance from the upstream pinch roller 52 to the print zone 36 as in the conventional printing apparatus of FIG. 1. Referring to FIG. 4, the minimum bottom margin for the printing apparatus 30 is the distance $d_m$, which extends from an area 86 adjacent to the distal edge of the shim 56 (in its advanced position) to the furthest edge 88 of the print zone 36. The distance between the area 86 and the distal edge of the shim 56 corresponds to the length of media sheet under the shim 56. The furthest edge 88 of the print zone 36 is defined by the most peripheral row 17 (e.g., of color K) of inkjet nozzles 35 furthest from the shim 56. As can be seen from FIG. 4, the distance $d_m$ is substantially less than the distances $d_p$, $d_{p'}$, of FIGS. 1 and 2, respectively. Thus, a smaller minimum bottom margin is achievable by the apparatus 30. This is true for apparatus embodiments which move a single sheet or cut sheet through the print zone 36, and is distinct from a continuous feed of attached media sheets which are not separated into individual sheets until after passing through the print zone.

Referring to FIGS. 8 and 9, a printing apparatus 130 is shown according to an alternative embodiment of this invention. Like parts of the apparatus relative to the components of the printing apparatus 30 of FIGS. 3 and 4 are given the same part numbers and perform the same functions. In this apparatus 130, the support is formed by a platen 32' rather than an endless loop belt 32 (as in the apparatus 30 of FIG. 3). Optional downstream pinch rollers 54, when included, are driven by a drive roller 132 (rather than an idler roller 42 as in FIG. 3). In various embodiment the platen 32' is stationary or moves with the trailing portion 55 of the media sheet 16 and the guide shim 56 during printing to the trailing portion of the media sheet. For a stationary platen embodiment the platen 32' extends at least the length of the print zone 36. For a moving platen 32', the platen moves between a first position adjacent to the upstream pinch roller 52 and drive roller 40 as shown in FIG. 8 to a second position adjacent to the downstream pinch roller 54 and the drive roller 132, as shown in FIG. 9. The motion of the platen 32' is driven by an actuator 134. The motion of the platen 32' is mechanically linked or, at the least, synchronized to the movement of the guide shim 56.

MERITORIOUS AND ADVANTAGEOUS EFFECTS

One advantage of the support, pinch roller, guide shim configuration is that media advance accuracy is maintained, and cockle growth is controlled, even while the media sheet trail edge leaves contact with the upstream pinch roller. A beneficial effect is that the minimum bottom margin is reduced. An advantage of the shim is that media advance accuracy is maintained even for pinch rollers which do not spin at identical speeds (e.g., due to manufacturing tolerances).

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet printing apparatus which moves a media sheet along a media path and marks the media sheet with ink, comprising:

an inkjet printhead having a plurality of inkjet nozzles which eject ink onto a portion of the media sheet located within a print zone, the print zone located adjacent to the plurality of nozzles;

a support which supports the media sheet as the media sheet passes along the media path through the print zone;

a roller located upstream along the media path prior to the print zone, the roller stabilizing the media sheet relative to a first surface during printing onto at least a first portion of the media sheet;

a guide shim located along the media path, the guide shim having a guide surface extending at least from the roller, beyond the roller toward the print zone during printing, the guide shim acting upon a portion of the media sheet between the roller and the print zone to keep the media sheet out of contact with the printhead; and means for advancing the guide shim along the media path toward the print zone during printing to at least a third portion of the media sheet, in which the advancing means comprises means for advancing the guide shim while a trailing edge of the media sheet moves into the print zone; and having a minimum media sheet page margin corresponding to a distance from inkjet nozzles located furthest from an edge of the guide shim to an area of the guide shim located adjacent to a distal edge of the guide shim while the guide shim is in an advanced position.

2. An inkjet printing apparatus which moves a media sheet along a media path and marks the media sheet with ink, comprising:

an inkjet printhead having a plurality of inkjet nozzles which eject ink onto a portion of the media sheet located within a print zone, the print zone located adjacent to the plurality of nozzles;

a support which supports the media sheet as the media sheet passes along the media path through the print zone;

a roller located upstream along the media path prior to the print zone, the roller stabilizing the media sheet relative to a first surface during printing onto at least a first portion of the media sheet;

a guide shim located along the media path, the guide shim having a guide surface extending at least from the roller, beyond the roller toward the print zone during printing, the guide shim acting upon a portion of the media sheet between the roller and the print zone to keep the media sheet out of contact with the printhead; and means for advancing the guide shim along the media path toward the print zone during printing to at least a third portion of the media sheet, in which the advancing means comprises means for advancing the guide shim while a trailing edge of the media sheet moves into the print zone; and having a minimum media sheet page margin corresponding to a distance from inkjet nozzles located nearest to an edge of the guide shim to an area of the guide shim located adjacent to a distal edge of the guide shim while the guide shim is in an advanced position.

3. A method for advancing a media sheet along a media path through a print zone of an inkjet printing apparatus, the apparatus including an inkjet printhead having a plurality of inkjet nozzles which eject ink, the print zone located adjacent to the plurality of nozzles, the method comprising the steps of:

receiving the media sheet at a roller which stabilizes the media sheet along the media path relative to a first surface, the roller located upstream along the media path prior to the print zone;

moving the media sheet under a guide shim toward the print zone, the guide shim acting upon a portion of the media sheet to maintain flatness and advance accuracy of the media sheet as a trailing edge of the media sheet travels beyond the roller toward the print zone;

ejecting ink onto a portion of the media sheet located within the print zone;

advancing the guide shim along the media path toward the print zone while a trailing portion of the media sheet moves into the print zone; and discontinuing ejection of ink onto the media sheet while leaving a media sheet margin at least as large as a minimum bottom margin, wherein the minimum bottom margin corresponds to a distance from inkjet nozzles located furthest from an edge of the guide shim to an area of the guide shim located adjacent to a distal edge of the guide shim while the guide shim is in an advanced position.

* * * * *